US007789156B2

(12) United States Patent
Pia

(10) Patent No.: US 7,789,156 B2
(45) Date of Patent: Sep. 7, 2010

(54) FLAPPER VALVE FOR USE IN DOWNHOLE APPLICATIONS

(75) Inventor: Giancarlo Pietro Tomasso Pia, Aberdeen (GB)

(73) Assignee: Renovus Limited, Aberdeen (GB)

( * ) Notice: Subject to any disclaimer, the term of this patent is extended or adjusted under 35 U.S.C. 154(b) by 0 days.

(21) Appl. No.: 11/805,108

(22) Filed: May 22, 2007

(65) Prior Publication Data

US 2007/0215361 A1 Sep. 20, 2007

Related U.S. Application Data

(63) Continuation-in-part of application No. 11/630,579, filed as application No. PCT/GB2005/002506 on Jun. 24, 2005, now abandoned.

(30) Foreign Application Priority Data

Jun. 24, 2004 (GB) ..... 0414128.9

(51) Int. Cl.
*E21B 34/10* (2006.01)
*F16K 1/18* (2006.01)

(52) U.S. Cl. ..... 166/332.8; 166/323; 166/375; 251/298

(58) Field of Classification Search ..... 166/332.1, 166/332.3, 332.8, 319, 325, 373, 374, 375, 166/323, 386; 251/89, 89.5, 95, 228, 298
See application file for complete search history.

(56) References Cited

U.S. PATENT DOCUMENTS

| | | | | |
|---|---|---|---|---|
| 2,849,207 | A * | 8/1958 | Conrad | 251/349 |
| 3,151,839 | A * | 10/1964 | Mott | 251/351 |
| 3,189,316 | A * | 6/1965 | Preston, Jr. | 251/74 |
| 3,713,485 | A * | 1/1973 | Holbert, Jr. | 166/321 |
| 3,826,309 | A * | 7/1974 | Tausch | 166/319 |
| 6,230,808 | B1 * | 5/2001 | French et al. | 166/323 |
| 6,328,109 | B1 * | 12/2001 | Pringle et al. | 166/373 |
| 6,508,309 | B1 * | 1/2003 | French | 166/323 |
| 2007/0204999 | A1 * | 9/2007 | Cowie et al. | 166/368 |
| 2009/0230340 | A1 * | 9/2009 | Purkis | 251/228 |

* cited by examiner

*Primary Examiner*—Kenneth Thompson
(74) *Attorney, Agent, or Firm*—Christopher L. Makay

(57) ABSTRACT

A downhole valve comprises a body defining a through bore and a valve member for location in the body and movable between an open position and a closed position. The valve has a first configuration in which the valve member is normally closed, and will hold a pressure differential in a first direction, and a second configuration in which the valve member is closed and will maintain a pressure differential in the first direction and also in an opposite second direction and a third configuration in which the valve member is locked in the open position until it is deliberately closed.

37 Claims, 1 Drawing Sheet

FLAPPER VALVE FOR USE IN DOWNHOLE APPLICATIONS

CROSS-REFERENCE TO RELATED APPLICATIONS

This application is a continuation-in-part of U.S. application Ser. No. 11/630,579, filed Dec. 22, 2006, which was based on International Application No. PCT/GB2005/002506, filed Jun. 24, 2005, which was based on Great Britain Application No. GB 0414128.9, filed Jun. 24, 2004.

FIELD OF THE INVENTION

This invention relates to valves, and in particular but not exclusively to valves for use in downhole applications.

BACKGROUND OF THE INVENTION

In the oil and gas exploration and production industry, subsurface hydrocarbon-bearing formations are accessed from surface by drilling bores, which bores are subsequently lined with metal tubing known as casing or liner. In instances where the formation pressure exceeds the hydrostatic pressure produced by the column of fluid in the well bore, one or more valves must be provided in the well bore to prevent uncontrolled escape of hydrocarbons from the well. In contrast, in other instances, it may be desirable to protect the formation from hydrostatic pressure to prevent fluid flowing into, and damaging, the formation, and in such cases the column of fluid in the well bore must be isolated from the formation.

A wide range of valves have been proposed and used in well bores to cope with the situations outlined above and to provide for, for example, the safe deployment of tools and devices into the well bore.

SUMMARY OF THE INVENTION

According to a first aspect of the present invention there is provided a valve including a body defining a through bore and a valve member for location in the body and movable between an open position and a closed position. The valve has a first configuration in which the valve member is normally closed, and will hold a pressure differential in a first direction, and a second configuration in which the valve member is closed and will maintain a pressure differential in said first direction and also in an opposite second direction.

The two different configurations of the valve extend the range of functionalities of the valve. For example, for use in managed pressure or under-balanced drilling applications, the valve may be utilised as a downhole deployment valve to isolate the formation from the well bore, that is the valve will hold a differential pressure from below. However, if the valve is reconfigured to the second configuration, a fluid barrier may be provided above the valve to operate in addition to the mechanical barrier provided by the valve member.

In accordance with a second aspect of the present invention there is provided a valve including a valve body and a valve member mounted in the body such that the valve member is movable between an open position and a closed position. The valve is operable in a fail as is mode and a fail-safe closed mode. Alternatively, or in addition, the valve could also be configured to be operable in a fail as is mode and a fail-safe open mode.

This aspect of the invention offers numerous advantages in that the fail-safe operation of the valve can be arranged to suit current operations. For example, in normal operation it may be desired to have the valve operate in fail-safe shut mode, such that the valve operates as a safety valve. However, when an item, such as a drill string, extends through the valve, it may be advantageous to have the valve locked open or fail open in order not to trap the string in the valve.

The above-noted aspects of the present invention may both be provided in the same valve, or may be provided independently.

Preferably, the valve is adapted to hold a differential pressure from below while in the first configuration, although in other embodiments the valve may be adapted to hold differential pressure from above. Preferably, the valve member is biased towards the closed position, for example by means of a suitable spring.

The valve member may take any appropriate form, including a ball valve. However, it is preferred that the valve member is a flapper valve, and most particularly a contoured or curved flapper.

Preferably, the valve includes an opening member, which will typically be in the form of a sleeve. The opening member may be biased towards a position which allows the valve member to close or remain in the closed position. The opening member may be movable to move the valve member from the closed position towards the open position. The opening member may incorporate a valve seat, or a valve seat may be provided independently of the member.

The opening member may be actuated by any appropriate means, but is preferably gas or fluid actuated. Thus, the opening member may be actuated by pressurised gas or liquid supplied from a remote gas or fluid source. In the preferred application of the valve, that is in a downhole environment, the actuating pressure will most likely be supplied from surface. The pressure may be supplied via appropriate control lines, or may be applied via an annulus, typically a secondary annulus provided between two casing strings, or via a drill pipe string or via an electro-hydraulic control system. The opening member may be subject to one or more selected actuation sequences, with actuating pressure being supplied by one or more gas or fluid conduits, which gas or fluid conduits could be control lines, an annulus, a drill pipe string or an electro-hydraulic control system. While the opening member itself may be hydraulically actuated, pressure may be applied or transmitted to the opening member actuating arrangement from surface via gas or liquid.

The opening member may incorporate a piston, and hydraulic fluid pressure acting on the piston will tend to move the piston to open the valve member. Preferably, means are provided for returning the opening member to a first or retracted position, in which the valve member may remain closed. The return means may utilise hydraulic fluid pressure, but most preferably comprises a spring, such that, for example, only a single hydraulic line or supply is required to provide or control movement of the opening member in both directions. The spring may comprise a mechanical spring or a pressure spring.

Preferably, the valve comprises a support member, which may be selectively positioned to maintain the valve member in the closed position. The support member may take any appropriate form, but is preferably in the form of a sleeve. In a first or retracted position the support member may permit movement of the valve member between the open and closed positions, however in a second or extended position the support member may prevent or restrict movement of the valve member from the closed position.

The support member may be moved towards the extended position by any appropriate means, but is preferably gas or fluid actuated. Gas or fluid actuation may be utilised to move the support member from the extended position to the retracted position, or a return spring or the like may be provided, however it is desired that an external mechanical force must be applied to the support member in order to retract the member.

Preferably, the valve includes a retaining member, which may be configured to retain the valve member in the open position. The retaining member may take the form of a sleeve, and may be movable between a retracted position in which the valve member is free to close, and an extended position in which the valve member is restrained in the open position, typically in a volume between the valve body and the retaining member.

In a preferred embodiment, a single member serves as both the support member and the retaining member, that is a support and retaining member may be selectively positioned to maintain the valve member in the closed position or in the open position, though in other embodiments it may be that two separate members are provided.

Both the opening member and support and/or retaining member(s) may be actuated by any appropriate means but are preferably fluid or gas actuated. Thus, the opening and support and/or retaining members may be actuated by pressurised gas or fluid supplied from a remote source, on surface or within the well. The pressure may be supplied via appropriate control lines or may be applied via an annulus, drillstring or any downhole control system. Both the opening and support and/or retaining members may be subject to one or more actuation sequences, with actuating pressure being supplied by one or more gas or fluid conduits, which gas or fluid conduits could be control lines, an annulus, drill pipe or an electro-hydraulic control system.

Actuation or activation of the opening, support or retaining members may utilize electrical or electronic systems or components, and these may form part of an electro-hydraulic control system. An electronic control system may be embedded within or otherwise operatively associated with the valve. The electronic control system may be utilized to detect actuation or activation signals, which signals may be pressure actuation signals. Actuation or activation signals may be generated remotely, downhole, or on surface. The source of the actuation signals may include a control line, flat-pack (typically two hydraulic lines bonded to a support cable, and sometimes including a signal-carrying cable), electrical or gas/hydraulic signals from surface, the bore of the valve-supporting tubular above or below the valve or valve member, the well annulus or the annulus between the valve supporting tubular and the surrounding casing string. In addition, or alternatively, the signal may be an electromagnetic signal, and the source of such a signal may be a drillstring, an MWD receiver or transmitter, or some other conduit deployed within the borehole.

A control system may receive an actuation or activation signal and subsequently trigger actuation or activation of a valve member, to function or move the valve member from one position to another. This actuation or activation may take the form of allowing hydraulic/gas pressure, well pressure or a mechanical arrangement to move or permit movement of the opening and support and/or retaining members to actuate the valve. The control system may also be time dependant allowing instant or delayed or controlled actuation or activation, which in turn provides instant, delayed or controlled actuation of the opening and support and/or retaining members within the valve. If desired, the actuation or activation sequence may be delayed for some considerable time to, for example, allow deployment of other tubulars or tools within the well. The control system may selectively activate or actuate the opening and support and/or retaining members independently, in a pre-determined sequence, in a sequence determined by the nature of the activation or actuation signal, or in a time-controlled manner to control the timing of activation or actuation of one or more of the members independently, in sequence or in a pre-determined sequence. Thus, the control system may be utilized to exert downhole control and actuation or activation in relation to one or more of the opening and support and/or retaining members, including the sequence, timing and the manner of valve opening.

Actuation of the opening member and support and/or retaining members can be done independently of, in association with, or in sequence with the other member or members using pre-determined pressure levels or sequences or rising pressure levels to trigger the actuation sequence.

Timing of the actuation of the opening member and support and/or retaining members within the valve can be sequenced or controlled using restrictors to restrict the pressure or fluid flow rate within the valve to control the timing and sequence of the members in relation to each other.

One or both of the support member and retaining member may cooperate with an opening member, and in one embodiment ends of a combined support and retaining member and an opening member may selectively engage or otherwise cooperate such that movement of one member induces movement of the other member, thus simplifying operation and control of the valve. Furthermore, if the actuating arrangement for one member should fail or be rendered inoperative, it may be possible to actuate the failed member via the other member. Also, where the two members track one another with little or no clearance therebetween, this serves to eliminate or reduce ingress of debris and cuttings behind the members and into the volume occupied by the valve member, which debris might otherwise interfere with the operation of the valve.

One or both of the support member and the retaining member may be actuated in a similar manner to the opening member, as described above.

The valve may be provided in combination with a catcher for location above the valve, which catcher may operate in conjunction with a dense fluid barrier above the valve. Preferably, the catcher includes one or more members for extending into the bore to arrest the fall of an item that might otherwise damage the valve. The members may be normally extended, or normally retracted. The members may be actuated in any appropriate manner, including by means of pressure, by gas or fluid control lines, or mechanically. The catcher may be integral with the valve, or may be provided separately. The catcher may be actuated independently or in combination with the valve, for example the catcher members may be extended independently of the valve configuration or may be extended and retracted as the valve is closed and opened.

Further aspects of the present invention relate to methods of reconfiguring valves of the first and second aspects between their respective configurations.

In still further aspects of the present invention two or more valves may be provided in a well bore. The valves may be made in accordance with the above described embodiments, but may take other forms, and one valve may take the form of a surface sealing device, such as a device to restrict or prevent flow around the BOPs, or a rotating control diverter as provided in an under balanced drilling (UBD) well. The valves may be located in close proximity to one another, or more preferably may be spaced apart, for example one deep set and one close to surface. Typically, the valves will be spaced apart sufficiently such that the space between the valves may accommodate and isolate a tool or device and, as described below, function in a somewhat similar manner to a surface lubricator. The valves may be spaced apart by a distance of 1000 feet or more, or a distance suitable to permit the volume between the valves to accommodate, for example, screens, inflatable screens, sand screens, logging tools, drilling assemblies, completions, well intervention tool strings and well work-over type strings, or indeed anything likely to be deployed into or retrieved from a live well. The valves may be operated simultaneously, but are most preferably independently operable.

The provision of two or more valves, not necessarily in accordance with the first and second aspects of the invention, offers numerous advantages. For example, closing a lower or deep set valve while opening an upper or shallow set valve allows a tool string, sandscreens, expandable tubulars or the like to be run into a live well and positioned between the valves, and the upper valve then closed. Conventional drill pipe or the like may then be run into the bore through conventional BOPs and the like, the upper valve opened, and the drill pipe string then stabbed into or otherwise connected to the tool string located between the valves. The lower valve may then be opened and the tool string advanced into the section of bore which intersects the formation.

The weight of the tool string may be selected such that, on opening the deep set valve, the weight of the string will provide a downward force substantially equal to or greater than any pressure force acting to push the string upwards and out of the bore. In certain embodiments such an object may itself act as a pressure barrier, and it may thus be possible to omit the upper valve.

This arrangement of valves or other pressure-containing devices is particularly useful in managed pressure drilling, that is in UBD wells or in wells drilled near or at balance. Indeed, all of the various different aspects of the invention disclosed herein are particularly well suited for use in managed pressure drilling applications.

Another aspect of the invention relates to a valve provided in combination with a sensor to measure or monitor the fluid level in the well above the valve, to ensure that the valve is not leaking. Such measurement may be, for instance, carried out using an echo meter.

Another aspect of the invention relates to the use of the valve as a measuring device of pressure below, above or at the valve depth, and the use of the valve as a MWD data receiver, transmitter or repeater.

Another aspect of the invention relates to the use of command or control data transmitted from a drill string, completion string or other tubular conduit deployed into the borehole to trigger a valve or remote electro-hydraulic control system to actuate the valve. In one embodiment of this aspect of the invention, ultrasonic waves or electromagnetic waves may be utilised to trigger the valve actuation sequencing.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figures 1, 2, 3, 4:
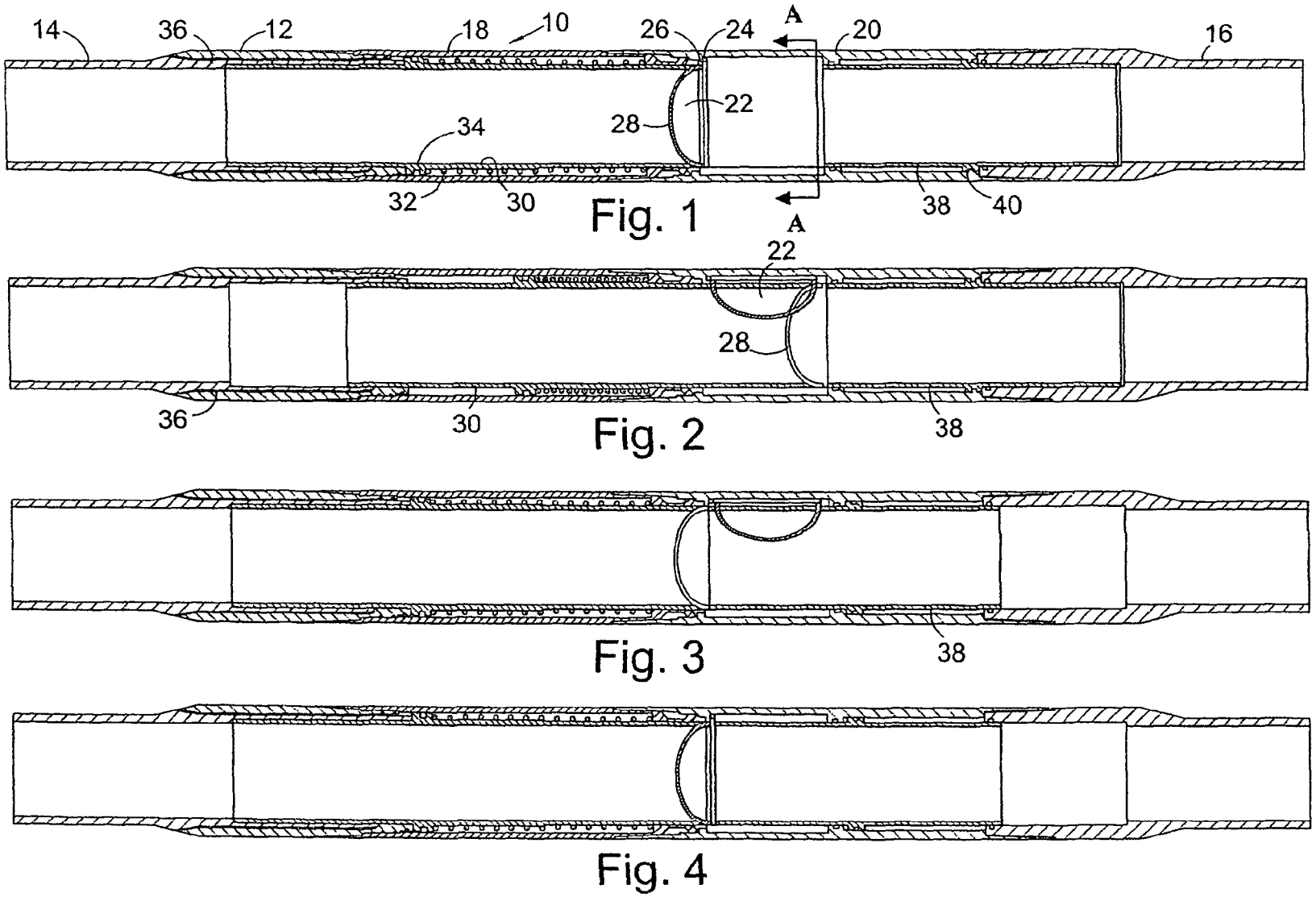
FIG. 1 shows a valve in accordance with the preferred embodiment of the present invention in a normally closed configuration, and configured to hold pressure from below.
FIG. 2 is a sectional view of the valve of FIG. 1, showing the valve open.
FIG. 3 is a sectional view of the valve of FIG. 1, showing the valve locked open.
FIG. 4 is a sectional view of the valve of FIG. 1, showing the valve locked closed.

The Figures illustrate a full bore isolation valve 10 in accordance with a preferred embodiment of the present invention. The valve 10 is intended to be incorporated in a string of tubulars to be located in a well bore, typically in a concentric casing string, that is a string of casing which is run inside casing or liner previously located in the well bore. The valve 10 has a generally cylindrical body 12 with top and bottom subs 14, 16 adapted for connection to adjacent sections of the casing string. The valve body 12 further comprises a spring housing 18 which is coupled to the top sub 14, and a flapper housing 20 which extends between the spring housing 18 and the bottom sub 16.

Mounted within the valve body 12 is a valve member in the form of a curved flapper 22. The flapper 22 is mounted to the housing 20 via a pivot pin 24 and a spring 26, the spring tending to move the flapper 22 to the closed position, as illustrated in FIG. 1. In other embodiments the flapper 22 could be mounted on a separate collar or the like within the body.

In the closed position the flapper 22 engages a valve seat 28 formed on the lower end of an opening sleeve 30 which is axially movably mounted within the body 12. The sleeve 30 is biased upwards towards the valve closed position, as illustrated in FIG. 1, by a compression spring 32. The upper end of the spring 32 engages a shoulder forming part of an annular piston 34 on the exterior of the sleeve 30. A fluid supply line 36 communicates with an upper face of the piston 34, such that supply of pressurised fluid via the line 36 will tend to move the sleeve 30 downwardly, and thus push the flapper 22 towards the open position, as illustrated in FIG. 2 of the drawings.

The lower part of the valve body 12 accommodates a support and retaining sleeve 38. In FIG. 1, the sleeve 38 is shown in the fully retracted position, in which the sleeve does not impact on the ability of the flapper 22 to open and close. Like the opening sleeve 30, the support and retaining sleeve 38 includes an annular piston 40 and a further hydraulic supply line allows the supply of hydraulic fluid to the lower side of the piston 40. Thus, by supplying fluid to the volume below the piston 40, it is possible to extend the sleeve towards the flapper 22.

FIGS. 1 and 2 of the drawings illustrate the valve 10 in a fail-safe shut configuration. That is, if the supply of hydraulic fluid to the valve 10 fails, the spring 32 will tend to return the sleeve 30 to its retracted position, as in FIG. 1, and the flapper spring 26 will tend to move the flapper 22 to the closed position. As will be described below, it is possible to reconfigure the valve 10 to a fail-safe open configuration. In particular, if, once the valve is open, as illustrated in FIG. 2, and the sleeve 30 has been extended such that the valve seat contacts the upper end of the support and retaining sleeve 38, hydraulic fluid is then supplied to extend the sleeve 38, while simultaneously fluid is permitted to bleed through the line 36, perhaps restricted in flow rate by a restrictor, and thus permit retraction of the sleeve 30. The support and retaining sleeve 38 will push the opening sleeve 30 upwards, and thus trap the flapper 22 behind the advancing sleeve 38. As long as pressure is maintained to extend the sleeve 38, the valve will remain open, as the flapper 22 is trapped behind the sleeve 38. However, even if the supply of hydraulic fluid tending to extend the sleeve 38 should fail, there is no return spring or other biasing force tending to retract the sleeve 38, such that the sleeve 38 will remain in its extended position, and the valve will remain open.

It will be noted that the ends of the sleeves 30,38 are in contact with each other, or at least close to each other, in a number of the valve configurations (FIGS. 2, 3 and 4). This offers two significant advantages, one being that the contacting sleeves may prevent ingress of debris, cuttings and other material into the volume between the valve body and the sleeves, which includes the space occupied by the open flapper 22. Furthermore, if the actuating arrangement for one sleeve fails, for example a fluid supply line is damaged or the spring 32 sticks, the other sleeve may be utilised to move the failed sleeve.

Thus, it will be apparent to those of skill in the art that the valve 10 may be configured as a fail-safe closed valve, when utilised in the configuration illustrated in FIGS. 1 and 2, or as a fail-safe open valve or fail as is when locked open, when used in the configuration illustrated in FIG. 3.

Furthermore, in the configuration illustrated in FIG. 1, the valve 10 is normally closed, and will hold a differential pressure from below. However, a differential pressure from above will tend to open the valve. This configuration is useful, for example, in an under-balanced situation, where the formation pressure, in communication with the lower end of the valve 10, is higher than the well bore pressure above the valve. However, there may be circumstances in which it is desired for the valve to have the facility to hold differential pressure from above, for example, if it is desired to fill the well bore with a relatively dense fluid and thus provide a further safety barrier between the formation and surface, which barrier may also serve to arrest the fall of items through the well bore which might otherwise damage the valve. This may be achieved by, starting from the valve configuration of FIG. 1, advancing the support and retaining sleeve 38 while the flapper 22 remains in the closed position. The sleeve 38 advances until the upper end of the sleeve 38 engages and supports the lower surface of the flapper 22. Thus, in the event of a differential pressure being applied from above the valve, the flapper 22 will be supported in the closed position by the extended sleeve 38.

Those of skill in the art will appreciate that the valve 10 described above offers many advantages over prior art valves. The low profile of the valve 10 allows the valve 10 to be, for example, passed through conventional casing of larger diameters, while permitting passage of standard drill bit sizes and drill string components through the valve.

Thus, the valve 10 has the ability to hold pressure from below, or alternatively the ability to hold pressure both from above and below. Of course in other embodiments the orientation of the valve 10 may be reversed, such that the valve is configured to hold pressure from above, or from above and below.

Those of skill in the art will recognise that the ability of the valve 10 to be configured in a fail-safe open or fail-safe shut configuration also offers significant advantages, and extends the operational envelope of the valve.

In the configuration in which the valve will hold pressure from both above and below, the valve 10 provides a mechanical barrier that is independent of well pressure. Furthermore, this allows a fluid barrier to be provided above the valve 10 in addition to the mechanical barrier provided by the valve itself, which allows provision of multiple barriers using only a single tool, and independent of well\reservoir pressure from below to make and hold the seal. The valve also has the ability to operate with a relatively high differential pressure across the valve.

If desired, the valve may include pressure sensors, communicating to surface, to permit monitoring of pressure above and below the valve 10, or detectors that indicate flapper or sleeve position. Alternatively, or in addition, the valve may include sensors for detecting electromagnetic (EM) or other signals, and means for relaying these signals towards surface by other means, for example through cabling. For example, the sensors may detect signals output by an EM MWD tool in the well bore below the valve, and transmit these signals to surface. This may be useful in applications where, for example, formations surrounding the well bore above the producing formation contains salt or brine and tend to attenuate EM signals.

The valve may be provided in combination with sensors to measure or monitor the fluid level in the well above the valve, to ensure that the valve is not leaking. Such measurement may be carried out, for example, by an echo meter.

As noted above, the valve 10 may be used singly, or two or more valves may be provided in a bore, or in the same string. The valves may operate completely independently with separate hydraulic lines passing from the valves to surface, or the valves may operate together, being linked by common hydraulic lines. Alternatively, the valves may be supplied using common hydraulic lines, but appropriate valving in the lines may be utilised such that, for example, a selected valve is only actuated when the pressure in the hydraulic lines rises above a predetermined level.

In other embodiments, one or both valves may be actuated in part via annulus pressure, or by pressure applied via a tubular support string, such as a string of drill pipe, or by a combination of both, as an alternative to or in addition to control line actuation. The ability to use different conduits to apply pressure to the valve or valves provides increased flexibility, and facilitates provision of different valve operating sequences.

One example of a use for running two valves in the same well is to allow running of sand control screens, which may be either solid or expandable. Currently, sand control screens cannot be run in accordance with conventional barrier policy in under-balanced wells, as even with a single deployment valve deep set and rotating blow-out preventors (RBOPs) or the snubbing unit as part of the surface BOP barrier environment, sand screens with holes in the tubes provide a possible leak path to the outside of the well at surface while the sand screen is located in the RBOP or snubbing unit. This problem can be overcome by running two valves, one deep set which may be used for all drilling activities as normal, and a second valve near to surface, to isolate the well near surface. In accordance with an embodiment of one aspect of the present invention, two valves as described above may be provided and a section of sand screen may be run into the well as follows.

Firstly, the surface RBOPs or BOPs are closed to isolate the well. The deep set valve is then closed to provide a mechanical barrier, isolating the hydrocarbon-producing formation from the upper part of the well bore. If the valve is locked closed, such that it may withstand differential pressure from above, a relatively dense fluid may then be circulated into the well bore above the deep set valve, to act as a second barrier.

The well pressure from the section of the well bore isolated above the deep set valve is then bled down, and checks made to ensure that there is no leak path past the deep set valve. The surface BOPs may then be opened and the sand screens deployed into the well, and hung off a profile just below the shallow set valves. The sand screen running string is then withdrawn and the shallow set valve and the surface BOPs are closed. Drill pipe is then run into the surface BOPs in conventional fashion for under-balanced tripping operations. The shallow set valve is opened and may be locked and the drill pipe run through the valve and the end of the drill pipe stabbed into the sand screens, which releases the hang-off of the sand screen. At this point, the surface BOPs form a seal with the drill pipe string. Next, pressure is allowed to equalise across the deep set valve, the valve is then opened and may be locked, and the sand screen then run through the open deep set valve.

It will be apparent to those of skill in the art that the above-described embodiments are merely exemplary of the present invention, and that various modifications and improvements may be made thereto, without departing from the scope of the invention. For example, in the aspects of the invention described above which utilise two spaced-apart valves, in other embodiments the upper valve could be replaced by an alternative barrier, such as an alternative valve form, an inflatable packer, or a mechanical set bridge plug type packer. Furthermore, a surface sealing device at the BOP or rotating control diverter may serve as the upper valve.

The invention claimed is:

1. A downhole valve, comprising:

a body defining a through bore;

a valve member for location in the body and movable between an open position and a closed position, the valve having a first configuration in which the valve member is normally closed, and will hold a pressure differential in a first direction, and a second configuration in which the valve member is closed and will maintain a pressure differential in said first direction and also in an opposite second direction; and an opening member mounted to the body and movable from a first position to a second position to move the valve member from the closed position towards the open position, the opening member being spring-biased towards one of the first and second positions.

2. The valve of claim 1, wherein the valve is operable as a downhole deployment valve, adapted to hold a differential pressure from below when in the first configuration.

3. The valve of claim 1, wherein the valve is adapted to hold a differential pressure from above when in the first configuration.

4. The valve of claim 1, wherein the valve is configurable in:

(a) at least one of a fail-safe as is mode and a fail-safe close mode, and (b) at least one of a fail safe as is mode and a fail-safe open mode.

5. The valve of claim 4, wherein the valve is operable in a fail-safe close mode, such that the valve operates as a safety valve.

6. The valve of claim 4, wherein the valve is operable in a locked open or fail-safe open mode.

7. The valve of claim 1, wherein the valve member is configurable to be biased towards the open position.

8. The valve of claim 1, wherein the valve member is a curved flapper.

9. The valve of claim 1, wherein the opening member is biased towards a position which allows the valve member to close or remain in the closed position.

10. The valve of claim 1, wherein a valve seat is provided independently of the valve member.

11. The valve of claim 1, wherein the opening member is gas or fluid actuated.

12. The valve of claim 11, wherein the opening member is actuated by pressurized gas or fluid.

13. The valve of claim 1, wherein the opening member is operable following at least one actuation sequence.

14. The valve of claim 13, wherein the actuation sequence is controlled by actuating fluid pressure supplied via at least one of a control line, annulus, tubular string, downhole control system, or electro-hydraulic control system.

15. The valve of claim 1, wherein the opening member comprises a piston, and fluid pressure acting on the piston will tend to move the member to open the valve member.

16. The valve member of claim 1, including return means for returning the opening member to a first position, in which the valve member remains closed.

17. The valve of claim 1, wherein the valve comprises at least one of: a support member, which support member may be selectively positioned to maintain the valve member in the closed position; and a retaining member configurable to retain the valve member in the open position.

18. The valve of claim 17, wherein at least one of the support member and the retaining member comprises a sleeve.

19. The valve of claim 17, wherein in a first position at least one of the support member and the retaining member permits movement of the valve member between the open and closed positions, and in a second position at least one of the support member and the retaining member prevents or restricts movement of the valve member.

20. The valve of claim 19, wherein at least one of the support member and the retaining member is gas or fluid actuated.

21. The valve of claim 17, wherein at least one of the support member and the retaining member is operable following at least one actuation sequence.

22. The valve of claim 21, wherein the actuation sequence is controlled by actuating fluid pressure supplied via at least one of a control line, annulus, tubular string, downhole control system and an electro-hydraulic control system.

23. The valve of claim 17, wherein at least one of the support member and the retaining member comprises a piston, and fluid pressure acting on the piston will tend to move the support member to maintain the valve member in the closed position, or will tend to move the retaining member towards the second position.

24. The valve of claim 17, including return means for returning at least one of the support member and the retaining member to a first position, permitting movement of the valve member between the open and closed positions.

25. The valve of claim 17, wherein a common member serves as both the support member and the retaining member.

26. The valve of claim 1, wherein the valve comprises a plurality of fluid actuated operating members and actuating fluid is supplied from within a well.

27. The valve of claim 26, wherein the operating members are adapted to be actuated independently.

28. The valve of claim 26, wherein at least one operating member is operable by an operating sequence using at least one of pre-determined pressure levels, pressure sequences or rising pressure levels.

29. The valve of claim 26, wherein actuation of the operating members is controlled by restriction of actuating fluid flow rate to control at least one of the timing and sequence of operation of the members in relation to each other.

30. The valve of claim 1, wherein at least one of a valve member support member and a valve member retaining member cooperate with an opening member.

31. The valve of claim 30, wherein a combined support and retaining member and an opening member are operatively associated such that movement of one member induces movement of the other member.

32. The valve of claim 31, wherein the combined support and retaining member and the opening member may selectively engage such that movement of one member induces movement of the other member.

33. The valve of claim 32, wherein the combined support and retaining member and the opening member are locatable to restrict ingress of material behind the members.

34. The valve of claim 1, in combination with a catcher for location above the valve and wherein the catcher includes at least one member for extending into a bore to arrest the fall of an item that might otherwise damage the valve.

35. A downhole valve, comprising:

a valve body defining a valve body bore extending the length of the body;

a valve member mounted in the body, the valve member being movable between an open position and a closed position; and the valve being configurable to at least one of a fail-safe as is mode and a fail-safe open mode, and to a fail-safe closed mode, wherein the valve is arranged to be reconfigured between the modes by activating pressure supplied from a pressurized source other than the valve body bore.

36. A method of operating a downhole valve, comprising:

providing a valve having a body defining a through bore extending the length of the body and a valve member in the body movable between an open position and a closed position;

configuring the valve in a first configuration in which the valve member is normally closed, and will hold a pressure differential in a first direction;

configuring the valve in a second configuration in which the valve member is closed and will maintain a pressure differential in said first direction and also in an opposite second direction; and reconfiguring the valve between the first and second configurations by application of activating pressure from a pressurized fluid source other than the through bore of the body.

37. A method of operating a downhole valve, comprising:

providing a valve comprising a valve body defining a valve body bore extending the length of the body and a valve member mounted in the body movable between an open position and a closed position;

configuring the valve in least one of a fail-safe as is mode and a fail-safe open mode;

configuring the valve in a fail-safe closed mode; and reconfiguring the valve between the modes by application of activating pressure from a pressurized fluid source other than the valve body bore.

* * * * *